US012253329B2

(12) United States Patent
Underwood et al.

(10) Patent No.: US 12,253,329 B2
(45) Date of Patent: Mar. 18, 2025

(54) HANDGUARD

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/554,933

(22) Filed: Dec. 17, 2021

(65) Prior Publication Data

US 2022/0196364 A1 Jun. 23, 2022

Related U.S. Application Data

(60) Provisional application No. 63/126,612, filed on Dec. 17, 2020.

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 968,583 A * 8/1910 Michaud ..... F41A 21/40 42/79
3,090,150 A * 5/1963 Stoner ..... F41A 13/12 42/71.01
4,536,982 A * 8/1985 Bredbury ..... F41C 23/16 42/71.01
4,663,875 A * 5/1987 Tatro ..... F41A 13/12 42/71.01
5,010,676 A * 4/1991 Kennedy ..... F41C 23/16 42/71.01
5,685,102 A * 11/1997 Latka ..... F41A 21/325 89/14.05
8,336,243 B2 * 12/2012 Langevin ..... F41C 23/16 42/71.01
8,528,246 B2 * 9/2013 Telles ..... F41C 23/16 42/71.01
8,640,372 B2 * 2/2014 Hochstrate ..... F41A 3/66 42/75.01
8,689,478 B2 * 4/2014 Patel ..... F41A 11/02 42/75.02
8,776,420 B2 * 7/2014 Langevin ..... F41C 23/16 42/71.01
9,228,799 B2 1/2016 Kuczynko
9,279,632 B2 * 3/2016 Hochstrate ..... F41A 3/66
9,482,485 B2 * 11/2016 Langevin ..... F41C 23/16
9,513,078 B1 * 12/2016 Fulton ..... F41A 21/325
9,528,793 B1 * 12/2016 Oglesby ..... F41C 27/00
9,658,010 B1 * 5/2017 Oglesby ..... F41C 23/16
9,683,808 B2 * 6/2017 Gagnon ..... F41C 23/16
(Continued)

*Primary Examiner* — Michelle Clement

(57) ABSTRACT

A handguard assembly for a firearm includes an outer member, an inner member disposed at least partially within the outer member, and at least one engagement feature for securing the inner member relative to the outer member. The at least one engagement feature includes at least one protrusion within an interior of the outer member and at least one recess in the inner member. The inner member is secured relative to the outer member by inserting the at least one protrusion into the at least one recess.

20 Claims, 5 Drawing Sheets

(56) References Cited

U.S. PATENT DOCUMENTS 9,964,374 B1* 5/2018 Facchini ..... F41A 21/484
10,260,838 B1 4/2019 Kincel et al.
10,386,149 B1* 8/2019 Facchini ..... F41A 5/26
10,928,160 B1* 2/2021 Becklin ..... F41A 3/66
11,391,532 B2* 7/2022 Markut ..... F41A 21/44
2007/0033851 A1* 2/2007 Hochstrate ..... F41A 21/482 42/75.01
2008/0301994 A1* 12/2008 Langevin ..... F41C 23/16 42/71.01
2009/0178325 A1* 7/2009 Veilleux ..... F41G 1/36 42/117
2010/0269392 A1* 10/2010 Swan ..... F41C 23/16 42/71.01
2012/0017482 A1* 1/2012 Chvala ..... F41C 23/16 42/71.01
2012/0111183 A1* 5/2012 Hochstrate ..... F41G 11/003 89/193
2013/0019513 A1 1/2013 Telles
2013/0133976 A1* 5/2013 Johansen ..... F41A 21/325 181/223
2014/0082990 A1* 3/2014 Lee ..... F41A 21/44 42/96
2015/0345896 A1* 12/2015 Michal ..... F41C 23/16 42/75.01
2017/0023329 A1* 1/2017 Gottzmann ..... F41C 23/16
2017/0199006 A1* 7/2017 Hwang ..... F41A 5/26
2017/0343315 A1* 11/2017 Beaty ..... F41C 23/16
2017/0363378 A1* 12/2017 Maffett ..... F41C 23/16
2018/0010881 A1* 1/2018 Garst ..... F41A 11/02
2018/0058807 A1* 3/2018 Cheng ..... F41A 5/26
2018/0128571 A1* 5/2018 Leitner-Wise ..... F41C 23/16
2018/0172384 A1* 6/2018 Maffett ..... F41A 3/66
2018/0195832 A1* 7/2018 Faxon ..... F41C 23/16
2019/0056188 A1* 2/2019 Miller ..... F41C 23/16
2019/0072354 A1* 3/2019 Lee ..... F41A 21/325
2019/0154396 A1* 5/2019 Zinsner ..... F41A 21/482
2020/0256636 A1* 8/2020 Martini ..... F41A 21/34
2021/0180903 A1* 6/2021 Markut ..... F41A 21/325
2022/0018629 A1* 1/2022 Senff ..... F41A 21/482

* cited by examiner

HANDGUARD

CROSS REFERENCE TO RELATED APPLICATION

This application is related to and claims priority benefit from U.S. Provisional Application No. 63/126,612 ("the '612 application"), filed on Dec. 17, 2020 and entitled "HANDGUARD." The '612 application is hereby incorporated in its entirety by this reference.

FIELD OF THE INVENTION

The field of the invention relates to firearms, particularly handguard assemblies for firearms where the handguard assembly extends forward from a receiver of the firearm and at least partially surrounds a barrel.

BACKGROUND

Many modern firearms are designed based on existing modular firearm systems. For example, many firearms and related accessories are designed for compatibility with the AR-15 variant (civilian) and/or M16/M4 (military) firearm platform (i.e., collectively, AR-15 style firearms). Many of these products follow traditional designs based on industry standards and/or military specification (milspec). A popular accessory for AR-15 style firearms for some consumers is a handguard that is located forward of the receiver of the firearm (e.g., an upper and/or a lower receiver). The operator may grip or hold the firearm by holding the handguard with his or her off hand (i.e., non-shooting hand). Conventional handguards may include features for securing the handguard to the firearm, for shielding heat from the firearm, and/or other relevant features.

To increase and improve comfort, heat management, manufacturability, and ergonomics, it may be desirable to design new handguard assemblies.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a handguard assembly for a firearm comprises: an outer member; an inner member disposed at least partially within the outer member; and at least one engagement feature for securing the inner member relative to the outer member, wherein: the at least one engagement feature comprises at least one protrusion within an interior of the outer member and at least one recess in the inner member; and the inner member is secured relative to the outer member by inserting the at least one protrusion into the at least one recess.

According to certain embodiments of the present invention, a firearm comprises: a receiver; a barrel; a first handguard assembly located forward of the receiver and adjacent to the barrel, the first handguard assembly comprising an outer member, an inner member, and at least one engagement feature for securing the inner member relative to the outer member; a second handguard assembly located forward of the receiver and adjacent to the barrel, the second handguard assembly comprising an outer member, an inner member, and at least one engagement feature for securing the inner member relative to the outer member, wherein: the outer member of the first handguard assembly comprises at least one first securing member and at least one second securing member; the outer member of the second handguard assembly comprises at least one first securing member and at least one second securing member; the at least one engagement feature of the first handguard assembly comprises at least one protrusion within an interior of the outer member and at least one recess in the inner member; and the at least one engagement feature of the second handguard assembly comprises at least one protrusion within an interior of the outer member and at least one recess in the inner member.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-5 illustrate components of various semi-automatic or automatic firearms, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, 0.410 gauge, 10 gauge, 16 gauge. The illustrated embodiments focus on components of the AR-15 variant (civilian) or M16/M4 (military) firearm platform (i.e., AR-15 style firearms); however, the concepts and features described herein are also applicable (with potential necessary alterations for particular applications) to other components of the AR-15 style firearm platform and to components of other firearms.

Figure 1:
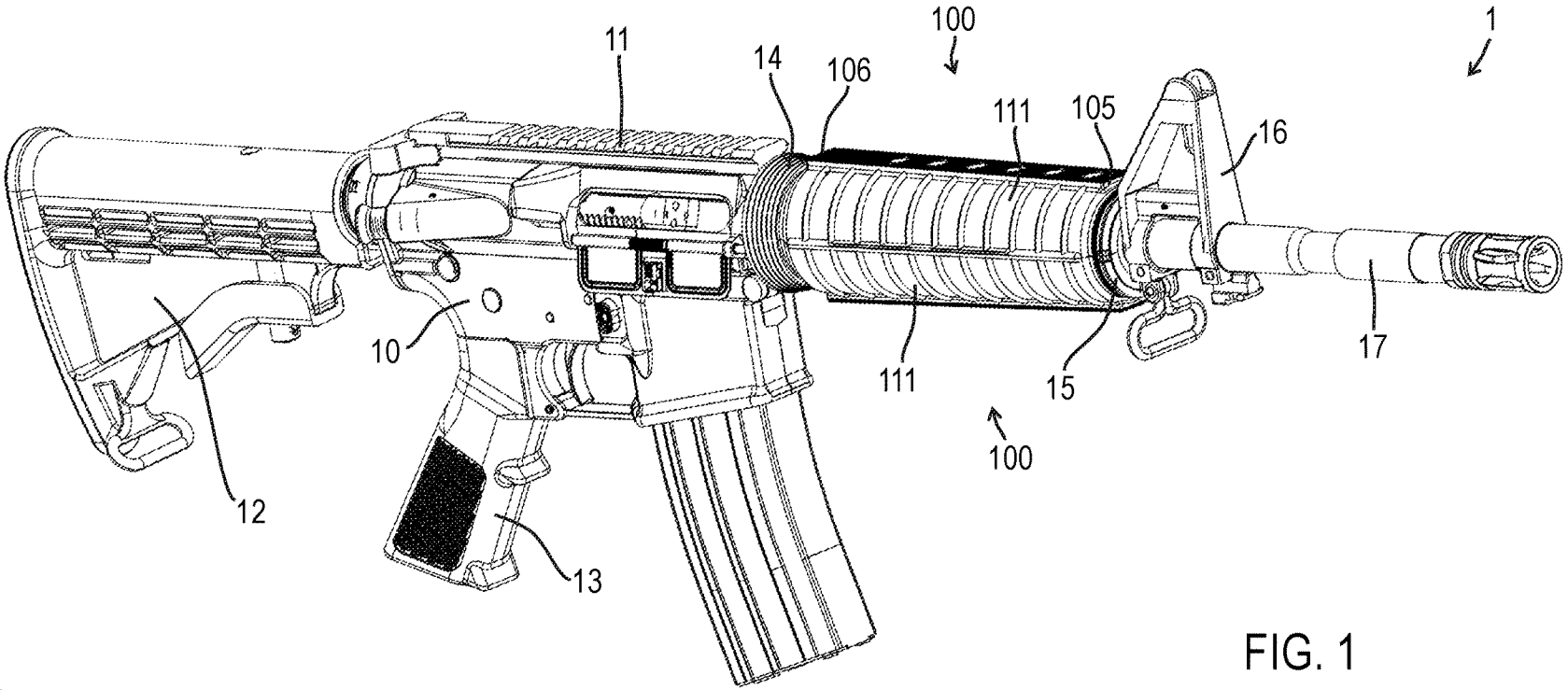
FIG. 1 is a front right perspective view of a firearm according to certain embodiments of the present invention.

In some cases, a firearm 1 includes a lower receiver 10, an upper receiver 11, a stock 12, a pistol grip 13, a delta ring 14, a handguard endcap 15, a front sight 16, a barrel 17, and at least one handguard assembly 100 (see FIG. 1). The firearm 1 may include multiple handguard assemblies 100 including, as shown in FIG. 1, a first handguard assembly 100 and a second handguard assembly 100. In some cases, the first handguard assembly 100 is an upper handguard assembly 100 and the second handguard assembly 100 is a lower handguard assembly 100. Accordingly, in some cases, an entire handguard may include two handguard assemblies 100. In some embodiments, the upper handguard assembly 100 and the lower handguard assembly 100 are identical. The handguard assemblies 100 illustrated are carbine length but all of the features described herein are applicable and can be included for handguard assemblies for mid-length, rifle length, pistol length, and/or any other appropriate size or style handguard assembly. The handguard assembly 100 may include an outer member 101 and an inner member 201 (see FIGS. 2A-3). The illustrated embodiments focus on components of an AR-15 style firearm with a traditional (in outer appearance) A2 handguard, however, the concepts and features described herein are also applicable (with potential necessary alterations for particular applications) to other components of the AR-15 style firearm platform and to components of other firearms.

As shown in FIG. 1, the firearm 1 may be formed such that an operator can hold the firearm 1 with his/her shooting hand holding the pistol grip 13 such that the operator's index finger (of the shooting hand) can reach the trigger. In some embodiments, the configuration of the at least one handguard assembly 100 provides a location for an operator to grip the firearm 1 with his/her off hand. The operator may hold the firearm 1 with his/her off hand primarily on the lower handguard assembly 100 with his/her fingers wrapping around to the upper handguard assembly 100. In other cases, the operator may hold the firearm 1 with his/her off hand primarily from a lateral direction such that the operator approximately equally grips the upper handguard assembly 100 and the lower handguard assembly 100.

Figure 2A:
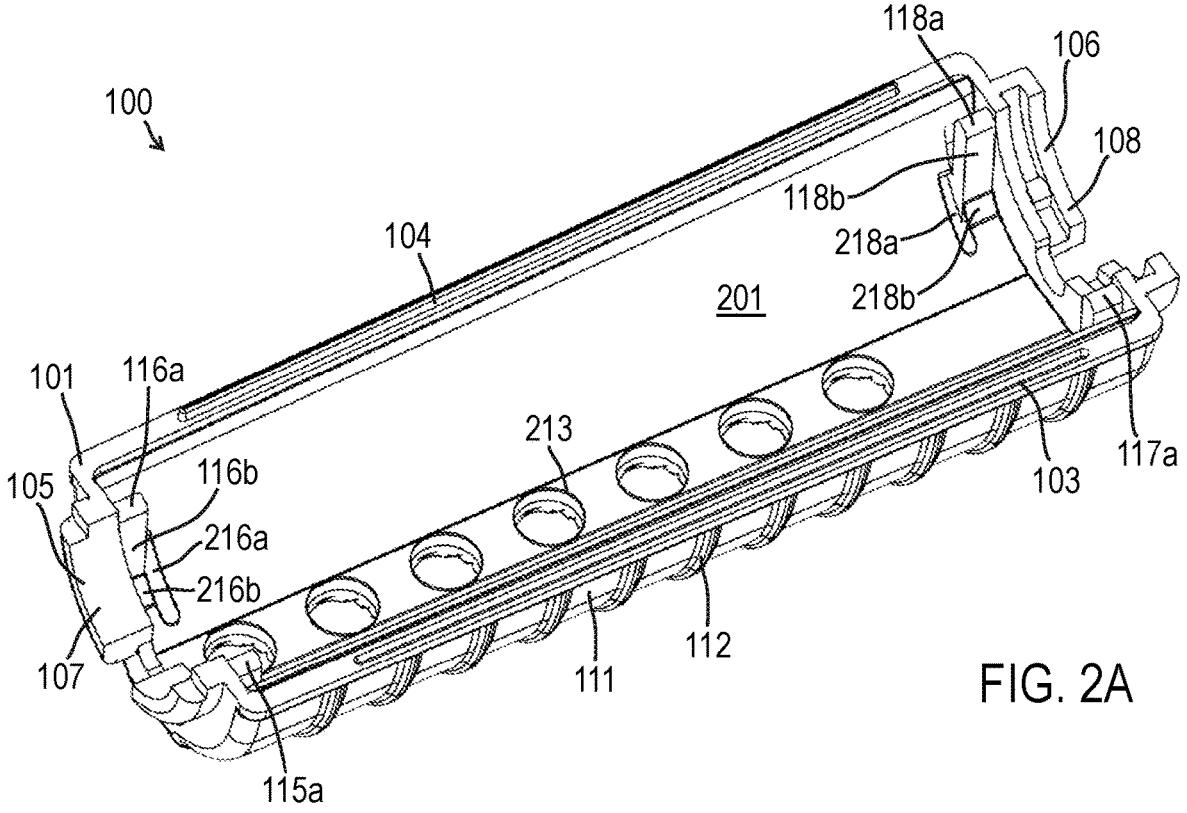
FIG. 2A is a front perspective view of a handguard assembly of the firearm of FIG. 1.
Figure 3:
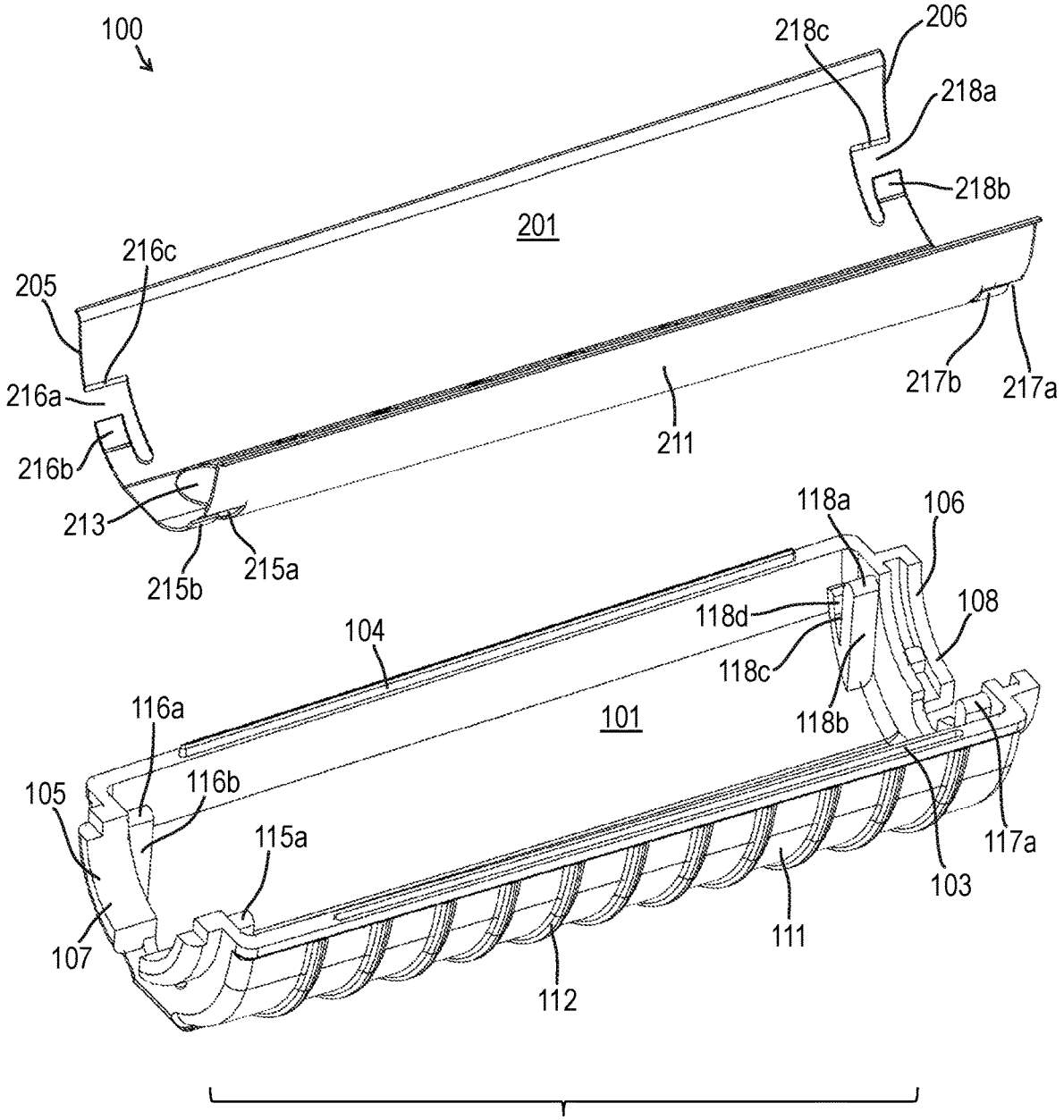
FIG. 3 is an exploded front perspective view of the handguard assembly of FIG. 2A.

The handguard assembly 100 may include an installed configuration for the inner member 201 and an uninstalled configuration for the inner member 201. An example of the installed configuration is shown in FIG. 2A where the inner member 201 is installed and secured within the outer member 101. FIG. 3 shows an example of the uninstalled configuration where the inner member 201 is separate and uninstalled relative to the outer member 101.

Figure 2B:
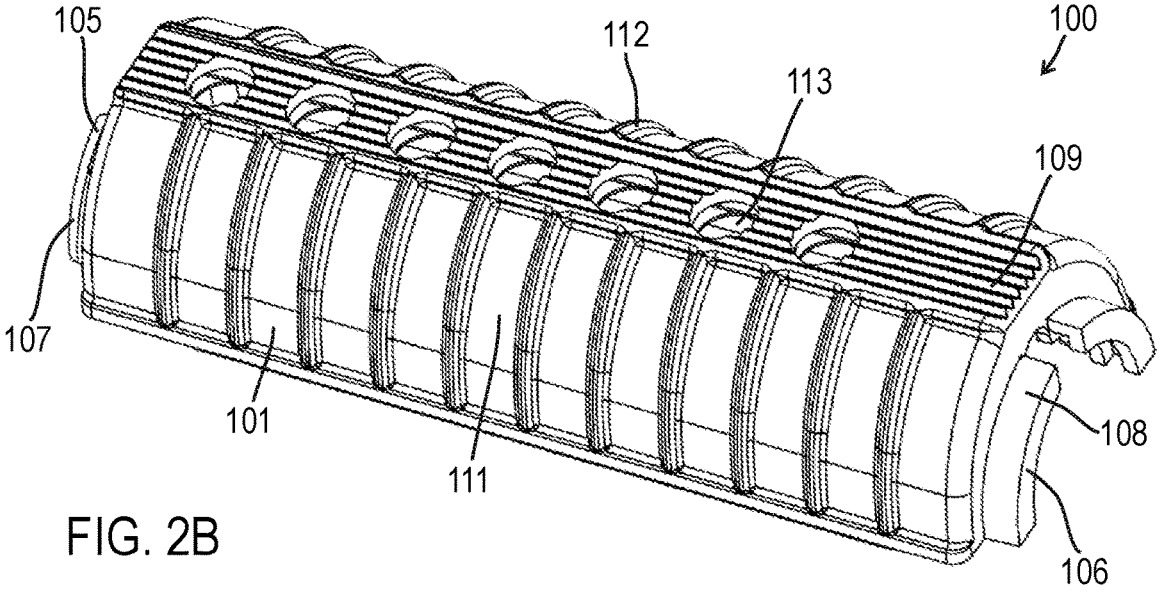
FIG. 2B is a rear perspective view of the handguard assembly of FIG. 2A.

As shown in FIG. 1, in some embodiments, the handguard assembly 100 extends forward in a direction approximately parallel to the barrel 17. In some embodiments, the outer member 101 includes a forward end 105, a rear end 106, and an outer surface 111 (see FIGS. 2A and 2B). The outer surface 111 of the handguard assembly 100 may have an approximately cylindrical shape (or semi-cylindrical external shape) that extends between the forward end 105 and the rear end 106. In some cases, the shape of the outer surface 111 of the handguard assembly 100 is conical (or partially conical) such that the forward end 105 has a smaller size (and/or diameter) than the rear end 106. As shown in FIGS. 2A and 2B, the outer surface 111 may include at least one rib 112, at least one channel 109, and at least one hole 113. In some cases, the at least one channel 109 is centrally located at the bottom (or top, depending on orientation) of the outer member 101. The at least one rib 112 may extend in a direction that is perpendicular to the direction of the at least one channel 109. The rib(s) 112 may follow a curved contoured path around the outer surface of the outer member 101. The outer surface of the outer member 101 may include a cross-section that is at least partially round, oval, elliptical, and/or any other appropriate shape. The at least one hole 113 may be located in or on the at least one channel 109. The outer member 101 may include at least one standoff 114 (see FIG. 4). Although the at least one standoff 114 is shown with a cylindrical shape (circular cross-section), the at least one standoff 114 may have a cross-sectional shape that is circular, square, oval, elliptical, polygonal, or any other appropriate shape. The forward end 105 may include an attachment feature 107 that interfaces with the handguard endcap 15 and is located rearward and/or approximately adjacent to the front sight 16. The rear end 106 may include an attachment feature 108 that interfaces with the delta ring 14 and is located forward and/or approximately adjacent to one or both of the lower receiver 10 and the upper receiver 11. In some embodiments, the at least one channel 109 may include a rail. The rail may be a Picatinny rail (MIL-STD-1913 rail or STANAG 2324 rail), a Weaver rail, or any other appropriate rail.

Figure 4:
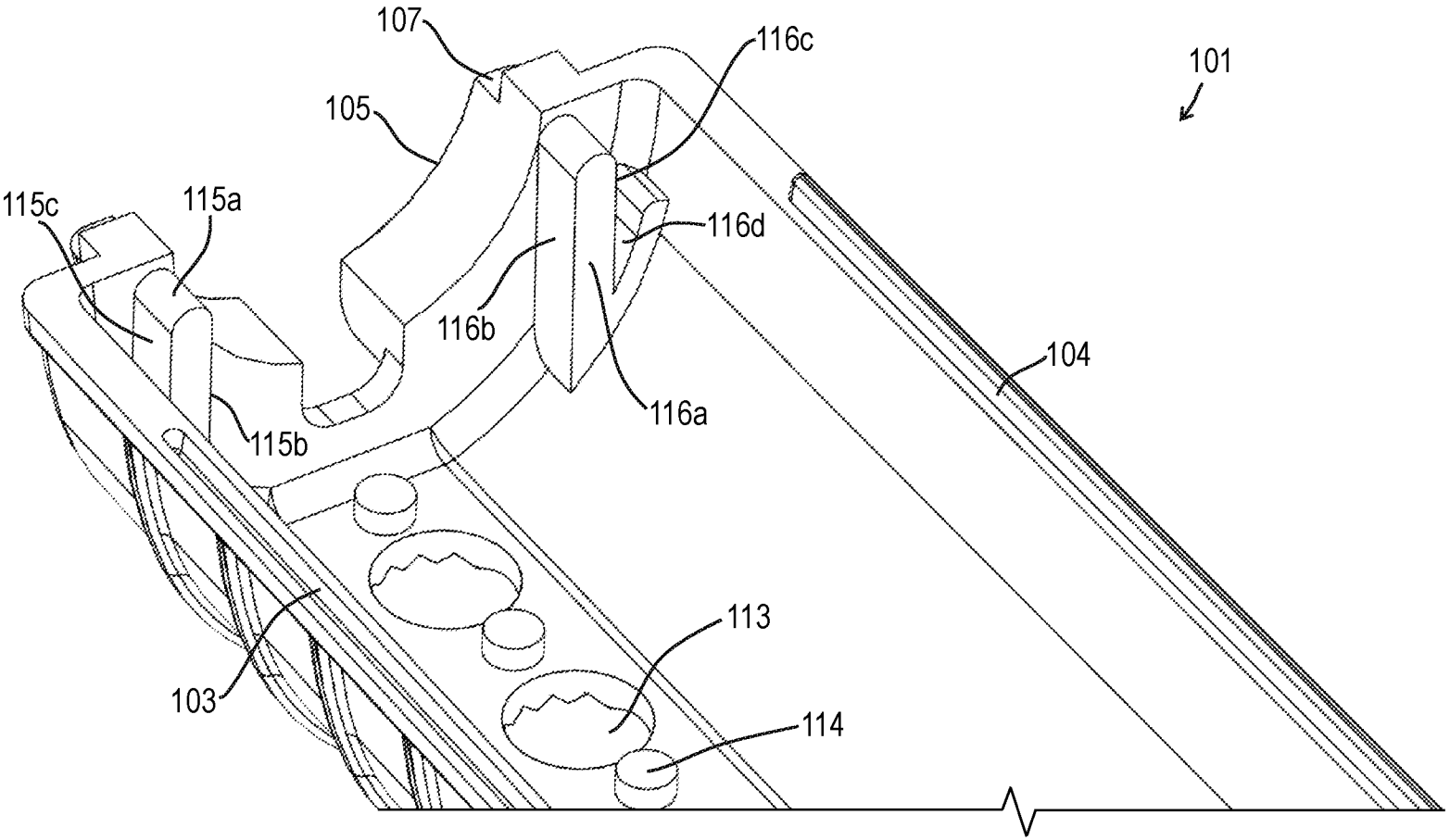
FIG. 4 is a partial perspective view of an outer member of the handguard assembly of FIG. 2A.
Figure 5:
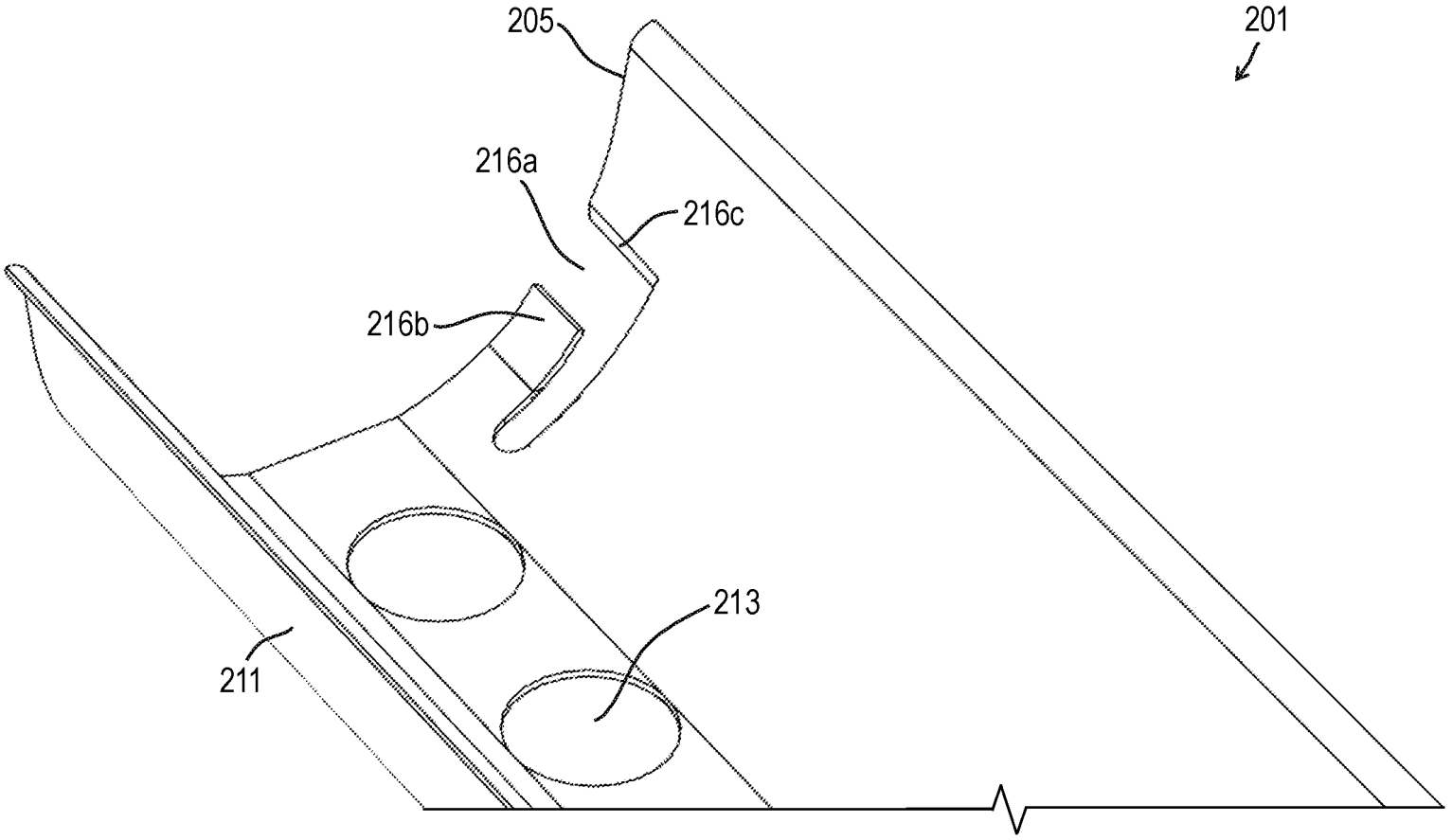
FIG. 5 is a partial perspective view of an inner member of the handguard assembly of FIG. 2A.

To arrange multiple handguard assemblies 100 together (e.g., see FIG. 1), the outer member 101 may also include at least one feature for securing a second outer member 101. For example, in some embodiments, the outer member 101 may include at least one first securing member 103 and at least one second securing member 104. As shown in FIGS. 2A, 3, and 4, the at least one first securing member 103 may be a female recess, and the at least one second securing member 104 may be a male protrusion with a corresponding shape. In some embodiments, the securing members 103, 104 have an approximately rectangular cross-sectional shape. Each end of the rectangular shape may be rounded or curved. The at least one first securing member 103 may be a single securing member (as illustrated) while in other embodiments, the at least one first securing member 103 may be a series of securing members. Similarly, the at least one second securing member 104 may be a single securing member (as illustrated) while in other embodiments, the at least one second securing member 104 may be a series of securing members. The securing members 103, 104 may have a cross-sectional shape that is circular, square, oval, elliptical, polygonal, or any other appropriate shape. In some embodiments, the securing members 103, 104 may extend along approximately 55%-95% of the length of the respective edges of the outer member 101. In some cases, the securing members 103, 104 may extend along approximately 70%-90% of the length of the respective edges of the outer member 101. In some embodiments, the securing members 103, 104 may extend along approximately 80% of the length of the respective edges of the outer member 101.

The inner member 201 may extend in the forward/aft direction within the outer member 101 surrounding and approximately parallel to the barrel 17 (as shown in FIGS. 2A-3). The inner member 201 may be a heat shield. In some embodiments, the inner member 201 includes a forward end 205, a rear end 206, an outer surface 211, and at least one hole 213 (see FIGS. 2A and 3). Each of the at least one hole 213 may be aligned with a corresponding hole 113 of the outer member 101. In other embodiments, the inner member 201 includes fewer or more holes than the outer member 101 where some or all of the hole(s) 213 of the inner member 201 are not aligned with the hole(s) 113 of the outer member 101. In other words, the holes may be arranged to slow the heat transfer out of the firearm 1 (away from the barrel 17) and/or to create a longer path for heat to escape through the handguard assembly 100. In some embodiments, the inner member 201 is metallic. In some cases, the inner member 201 is stamped sheet metal. For example, the inner member 201 may include a flat plate that is formed or bent to the shape shown in FIGS. 3 and 5. In other cases, the inner member 201 is a non-metallic material.

In some embodiments, the handguard assembly 100 includes engagement features for engaging the inner member 201 relative to the outer member 101. The handguard assembly 100 may include two, four, six, eight, or any other appropriate number of engagement features. For example, the outer member 101 may include at least one protrusion 115*a*, 116*a*, 117*a*, 118*a* and the inner member 201 may include at least one recess 215*a*, 216*a*, 217*a*, 218*a* that corresponds to the relevant protrusion. Each protrusion 115*a*, 116*a*, 117*a*, 118*a* may include an inboard surface (facing the interior of the outer member 101), an outboard surface (facing away from the interior of the outer member 101), and an offset surface. For example, protrusion 116*a* includes an inboard surface 116*b*, an outboard surface 116*c*, and an offset surface 116*d* (see FIGS. 2A, 3, and 4) and protrusion 118*a* includes an inboard surface 118*b*, an outboard surface 118*c*, and an offset surface 118*d* (see FIGS. 2A and 3). Each recess 215*a*, 216*a*, 217*a*, 218*a* may include a tab and an edge. For example, recess 216*a* includes a tab 216*b* and an edge 216*c* (see FIGS. 2A, 3, and 5) and recess 218*a* includes a tab 218*b* and an edge 218*c* (see FIGS. 2A and 3). In some embodiments, each recess 215*a*, 216*a*, 217*a*, 218*a* may include a shape that is approximately "L" shaped. As an exemplary case, the interaction between protrusion 118*a* and recess 218*a* is described below. The other portions of the assembly (e.g., protrusions 115*a*, 116*a*, 117*a* and recesses 215*a*, 216*a*, 217*a*) may function in a similar manner and are not duplicated in the description.

Although the illustrated examples of the protrusions 115*a*, 116*a*, 117*a*, 118*a* include a rectangular cross-section with distinct surfaces (as described above), the protrusions 115*a*, 116*a*, 117*a*, 118*a* may include any appropriate cross-sectional shape including, for example, circular, elliptical, oval, square, pentagonal, hexagonal, heptagonal, octagonal, etc. The recesses 215*a*, 216*a*, 217*a*, 218*a* will have the corresponding appropriate shape.

As illustrated in FIGS. 2A-3, each handguard assembly 100 may include multiple engagement features at the forward end 105, 205 and multiple engagement features at the rear end 106, 206 for securing the inner member 201 relative to the outer member 101. In some embodiments, there may be a first engagement feature located approximately halfway between the channel 109 and a first outer edge (i.e., at the first securing member(s) 103) and a second engagement feature located approximately halfway between the channel 109 and a second outer edge (i.e., at the second securing member(s) 104). The first engagement feature and the second engagement feature may be mirrored relative to one another.

As shown in FIGS. 2A and 3, the inner member 201 may be pressed into the interior of the outer member 101 such that at least a portion of the protrusion 118*a* passes through recess 218*a*. In particular, part of the protrusion 118*a* may pass between tab 218*b* and edge 218*c* of recess 218*a*. The protrusion 118*a* may include an inboard surface 118*b* (facing the interior of the outer member 101) and an outboard surface 118*c* (facing away from the interior of the outer member 101). The shape of the recess 218*a* dictates that tab 218*b* extends from a relatively narrow neck. The recess 218*a* of the inner member 201 may be designed such that the distance between the tab 218*b* and the edge 218*c* is smaller than the dimension of the protrusion 118*a* (i.e., the distance between the inboard surface 118*b* and the outboard surface 118*c*). Accordingly, as the inner member 201 is pressed into the interior of the outer member 101 and the edge 218*c* of the recess 218*a* makes contact with the outboard surface 118*c* of the protrusion 118*a*, the tab 218*b* presses against the inboard surface 118*b* such that the tab 218*b* deflects inward. Due to the contour/shape of the inner member 201, the deflection of the tab 218*b* caused by the interaction with the inboard surface 118*b* dictates that the tab 218*b* engages and locks itself against the surface of the inboard surface 118*b*. The inner member 201 may be pressed into the interior of the outer member 101 until the outer surface 211 of the inner member 201 contacts (i) the offset surface 118*d* and/or (ii) the top of the standoff 114 (see FIG. 4). In addition to the offset surface 118*d*, the outer member 101 may include analogous offset surfaces for each of the protrusions 118*a*, 118*b*, 118*c*. For example, the offset surface 116*d* is shown in FIG. 4.

In some embodiments, the handguard assembly 100 is designed such that the inner member 201 is to be pressed into the interior of the outer member 101 (as described above) without provisions for removal. In other words, the inner member 201 is not designed to be removable from the outer member 101. In some cases, the inner member 201 can be removed from the outer member 101 by prying or bending the tab(s) (e.g., tab 216*b* and tab 218*b*) away from the corresponding protrusion (e.g., protrusion 116*a* and 118*a*). For example, an operator may use a tool (e.g., a flat head screwdriver) to deform or bend at least one of the tabs away from the corresponding protrusion.

The components of any of the handguard assemblies 100 and/or firearms 1 described herein may be formed of materials including, but not limited to, thermoplastic, carbon composite, plastic, nylon, glass-filled nylon, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A handguard assembly for a firearm, the handguard assembly comprising:

an outer member;

an inner member disposed at least partially within the outer member; and at least one engagement feature for securing the inner member relative to the outer member, wherein:

the at least one engagement feature comprises at least one protrusion integrally formed as part of the outer member and at least one recess in the inner member; and the inner member is secured relative to the outer member by inserting the at least one protrusion into the at least one recess.

2. The handguard assembly of claim 1, wherein:

the outer member comprises four protrusions; and the inner member comprises four corresponding recesses.

3. The handguard assembly of claim 1, wherein the at least one recess comprises an approximate "L" shape.

4. The handguard assembly of claim 1, wherein the inner member comprises an installed configuration and an uninstalled configuration, wherein in the installed configuration, a tab of the inner member bears against an inboard surface of the at least one protrusion of the outer member.

5. The handguard assembly of claim 1, wherein the inner member comprises a heat shield that has an overall approximately cylindrical shape with a flat portion near a center of the heat shield.

6. The handguard assembly of claim 1, wherein the outer member comprises at least one standoff that sets a distance between a surface of the outer member and a surface of the inner member.

7. The handguard assembly of claim 1, wherein the outer member comprises at least one first securing member and at least one second securing member, wherein the securing members are designed to engage corresponding features of a second outer member of a second handguard assembly.

8. The handguard assembly of claim 7, wherein:

the at least one first securing member and the at least one second securing member comprise an approximately rectangular cross-sectional shape;

the at least one first securing member comprises a female recess and the at least one second securing member comprises a male protrusion.

9. The handguard assembly of claim 1, wherein the outer member comprises a polymer material that is injection molded such that the at least one protrusion is molded as part of the outer member and the inner member comprises a metallic material.

10. The handguard assembly of claim 1, wherein the at least one recess comprises a tab that deflects due to interaction with the at least one protrusion.

11. A firearm receiver assembly comprising:

a receiver;

a barrel;

a first handguard assembly located forward of the receiver and adjacent to the barrel, the first handguard assembly comprising an outer member, an inner member, and at least one engagement feature for securing the inner member relative to the outer member, a second handguard assembly located forward of the receiver and adjacent to the barrel, the second handguard assembly comprising an outer member, an inner member, and at least one engagement feature for securing the inner member relative to the outer member, wherein:

the at least one engagement feature of the first handguard assembly comprises at least one protrusion within an interior of the outer member and at least one recess in the inner member, wherein the at least one recess comprises a tab that deflects due to interaction with the at least one protrusion; and the at least one engagement feature of the second handguard assembly comprises at least one protrusion within an interior of the outer member and at least one recess in the inner member, wherein the at least one recess comprises a tab that deflects due to interaction with the at least one protrusion.

12. The firearm receiver assembly of claim 11, wherein the first handguard assembly and the second handguard assembly are identical.

13. The firearm receiver assembly of claim 11, wherein:

the inner member of the first handguard assembly is secured relative to the outer member of the first handguard assembly by inserting the at least one protrusion into the at least one recess; and the inner member of the second handguard assembly is secured relative to the outer member of the second handguard assembly by inserting the at least one protrusion into the at least one recess.

14. The firearm receiver assembly of claim 11, wherein at least one of the at least one protrusions comprises at least a portion that passes entirely through the corresponding recess.

15. The firearm receiver assembly of claim 11, wherein the at least one recess of each inner member comprises an approximate "L" shape.

16. The firearm receiver assembly of claim 11, wherein each of the inner members comprises an installed configuration and an uninstalled configuration, wherein in the installed configuration, each tab of the inner member bears against an inboard surface of the at least one protrusion of the respective outer member.

17. The firearm receiver assembly of claim 11, wherein each of the inner members comprises a heat shield.

18. The firearm receiver assembly of claim 11, wherein:

the outer member of the first handguard assembly comprises at least one first securing member and at least one second securing member;

the outer member of the second handguard assembly comprises at least one first securing member and at least one second securing member;

the at least one first securing member of the first handguard assembly engages the at least one second securing member of the second handguard assembly;

the at least one second securing member of the first handguard assembly engages the at least one first securing member of the second handguard assembly;

each of the at least one first securing members and each of the at least one second securing members comprises an approximately rectangular cross-sectional shape; and each of the at least one first securing members comprises a female recess and each of the at least one second securing members comprises a male protrusion.

19. The firearm receiver assembly of claim 11, wherein each outer member comprises a polymer material and each inner member comprises a metallic material.

20. The firearm receiver assembly of claim 11, wherein:

the at least one protrusion of the at least one engagement feature of the first handguard assembly is integral to the outer member of the first handguard assembly; and the at least one protrusion of the at least one engagement feature of the second handguard assembly is integral to the outer member of the second handguard assembly.

* * * * *